US006866353B2

(12) United States Patent
Wertsberger

(10) Patent No.: US 6,866,353 B2
(45) Date of Patent: Mar. 15, 2005

(54) ELECTROSTATIC DISCHARGE DEVICE

(76) Inventor: Shalom Wertsberger, 30 Fern La., South Portland, ME (US) 04106

( * ) Notice: Subject to any disclaimer, the term of this patent is extended or adjusted under 35 U.S.C. 154(b) by 444 days.

(21) Appl. No.: 09/749,216

(22) Filed: Dec. 27, 2000

(65) Prior Publication Data

US 2002/0080549 A1 Jun. 27, 2002

(51) Int. Cl.[7] ..... H05F 3/00
(52) U.S. Cl. ..... 316/212; 316/216; 316/220
(58) Field of Search ..... 361/111, 212, 361/220, 225, 56

(56) References Cited

U.S. PATENT DOCUMENTS 3,621,164 A * 11/1971 Stanley ..... 200/61.58 R
4,586,106 A 4/1986 Frazier
4,654,746 A 3/1987 Lewis, Jr. et al.
4,821,320 A 4/1989 Andert et al.
4,852,374 A 8/1989 Gotanda
5,222,013 A 6/1993 Schwalm
5,281,155 A 1/1994 Comerci et al.
5,283,710 A 2/1994 Hamilton et al.

* cited by examiner

*Primary Examiner*—Kim Huynh

(57) ABSTRACT

An electrostatic discharge device adapted to be mounted to an electrical fixture wallplate is disclosed. The discharge device consists of a circuit having at least a resistor and preferably a non-linear discharge component mounted on an electrical fixture wallplate. Another embodiment has an electrical discharge circuit built within an electrical switch.

23 Claims, 6 Drawing Sheets

ELECTROSTATIC DISCHARGE DEVICE

FIELD OF THE INVENTION

This invention relates to electrostatic discharge devices in general and more particularly to an electrostatic discharge device coupled with electrical fixtures or electrical fixture wallplates.

BACKGROUND OF THE INVENTION

The human body may collect several thousand volts of electrostatic charge under numerous common conditions, such as from friction with synthetic material in closing, carpets or chairs, from close proximity to radiating devices such as computer monitors and televisions, etc. Such electrostatic charge is undesirable for many reasons, amongst which is protection of sensitive electronic equipment, aesthetic appearance, and others.

When a person having a high level of electrostatic charges touches a grounded object, or even gets in close proximity to a grounded object, a fast discharge is affected, commonly accompanied by an air insulation breakdown, manifested by a spark. Due to the high voltage involved, the discharge involves relatively high current, albeit for a very short period of time. Without any device to limit charge flow, the fast discharge causes a small but painful electric shock. It is known that reducing the current reduces the shock and pain involved with such discharge.

Electrical circuits to eliminate electrostatic charge are known in several forms. The simplest circuit for this purpose is a resistor, preferably in the range of several mega ohms, one terminal of which is connected to an electrical ground, while a user can touch the other terminal. The resistor limits the flow rate and the static charge safely dissipates to ground.

An improved static discharge circuit comprises a non-linear discharge component connected in series with a resistor. A neon bulb is probably the most widely used high voltage discharge component since it can absorb high tension without damage. However other non-linear resistance components such as zener diodes, diacs, triacs, spark gap devices, tunnel diodes and others may be used. Connecting such a component in series with the resistor tends to prevent the spark that may occasionally accompany discharge into a circuit comprising only a resistor, and further contributes to reducing the unpleasant sensation of sudden electrostatic discharge. A neon bulb and a spark gap are two non-linear discharge components that are discussed at length in these specifications. It should however be noted, that other non-linear components may be interchangeably and equivalently used in different circuit configurations as known.

There is a clear and present need for an inexpensive device that will provide for easy discharge of an electrostatic charge of a human body. A device that is easily and commonly integrated in predictable locations within an office or a house environment. The present invention is directed towards such a device.

SUMMARY OF THE INVENTION

Nowadays, most rooms contain electrical fixtures such as light and power switches, power receptacles, network and telephone connectors, electrical junction boxes, etc. Most electrical codes require that all electrical fixtures and many of the communications fixtures be grounded, and most require a wallplate installed to meet safety standards. Wallplates (interchangeably known as cover plates) have slots or apertures cut therein to accommodate electrical fixtures such as, by way of example, switches, dimmers, receptacles, connectors, controllers, etc. The wallplates are typically composed of electrically insulating material, and are secured in place by one or more fasteners, that are often grounded. A very common electrical fixture that is readily accessible is a switch, such as a light switch affixed to a wall near a room or office entrance. Accordingly these specifications will commonly relate to the invention in an embodiment relating to a light switch. It is however understood that the description and the invention also relates to other electrical fixtures such as electric junction boxes, power receptacles, telephone and network receptacles, and similar equipment in a similar fashion or with but minor modifications.

By placing a static discharge device in several places around a house or office a user may affect electrostatic discharge frequently, thus avoiding painful shocks and reducing the risk of damaging electrostatic sensitive devices. Due to the ready availability of electrical switches and receptacles, placing a device in close proximity to those fixtures provides an excellent solution to allow frequent discharge. The present invention in its broadest, most preferred form, is directed to placing an electrostatic discharge device on, or preferably integral to wallplates designed to cover electrical fixtures. Fixtures are commonly mounted in electrical distribution boxes, also known as a gem box, and the wallplate is designed to cover such gem box.

Therefore, the invention provides an electrostatic discharge device constructed of an electrical fixture wallplate having an outer surface and an inner surface, and having at least one grounding point. A contact electrode is affixed to the outer surface, and an electrostatic discharge circuit, preferably at least partially mounted to the inner surface. The circuit comprises at least one resistor connected between a first and a second terminal points, wherein the first terminal point is electrically coupled to the contact electrode, and the second terminal point is electrically coupled to the grounding point. In the preferred implementation, the contact electrode 20 is at least one electrode, preferably metallic, deposited on the periphery of the outer surface 75 of the wallplate.

The electrostatic discharge circuit provides electrical connection between the contact electrode 20 and the grounding point 60. The electrostatic discharge circuit goal is to permit electrical charge flow from the contact electrode to the grounding point, while limiting the current flow therebetween, and thus slow the rate of change of a user's electrical charge. The circuit comprises a minimum of a resistor 15, preferably having a high electrical resistance value in the order of several mega ohms or more preferably several tens of megaohms.

In another aspect of the invention, an electrical discharge component 25 is connected in series with the resistor.

Thus in a basic form, the invention provides for a device to dissipate electrostatic charge, substantially integral to a wallplate. This is achieved by placing a contact electrode on the outer surface of the wallplate, so as to make it accessible from outside the gem box. The electrode is connected to a discharge circuit that is connected to electrical ground when the wallplate is mounted. The circuit comprises at least a resistor, and preferably also a neon bulb 25 in series therewith. The circuit provides a discharge path between the contact electrode and ground. Thus the discharge circuit has at least two terminal points, one of which is connected to the contact electrode and the other to the grounding point. The circuit components are at least partially mounted by any convenient means to the wallplate. In the most proffered embodiment, the resistor and electrode portions are printed or otherwise deposited on the wallplate.

In use, the user can easily touch the electrode 20, or merely get his/her hand in close enough proximity to the electrode, to affect a discharge.

SHORT DESCRIPTION OF DRAWINGS

This invention may be better understood from the descriptions and claims that follow, and from the accompanying drawings in which:

FIG. 1 depicts a front view of a wallplate in accordance with an embodiment of the invention FIG. 2 depicts a rear view of a wallplate in accordance with an embodiment of the present invention.

FIG. 3, 4, and 5 are each schematic diagram of base embodiments of the electrostatic discharge circuit.

DETAILED DESCRIPTION

Figure 1:
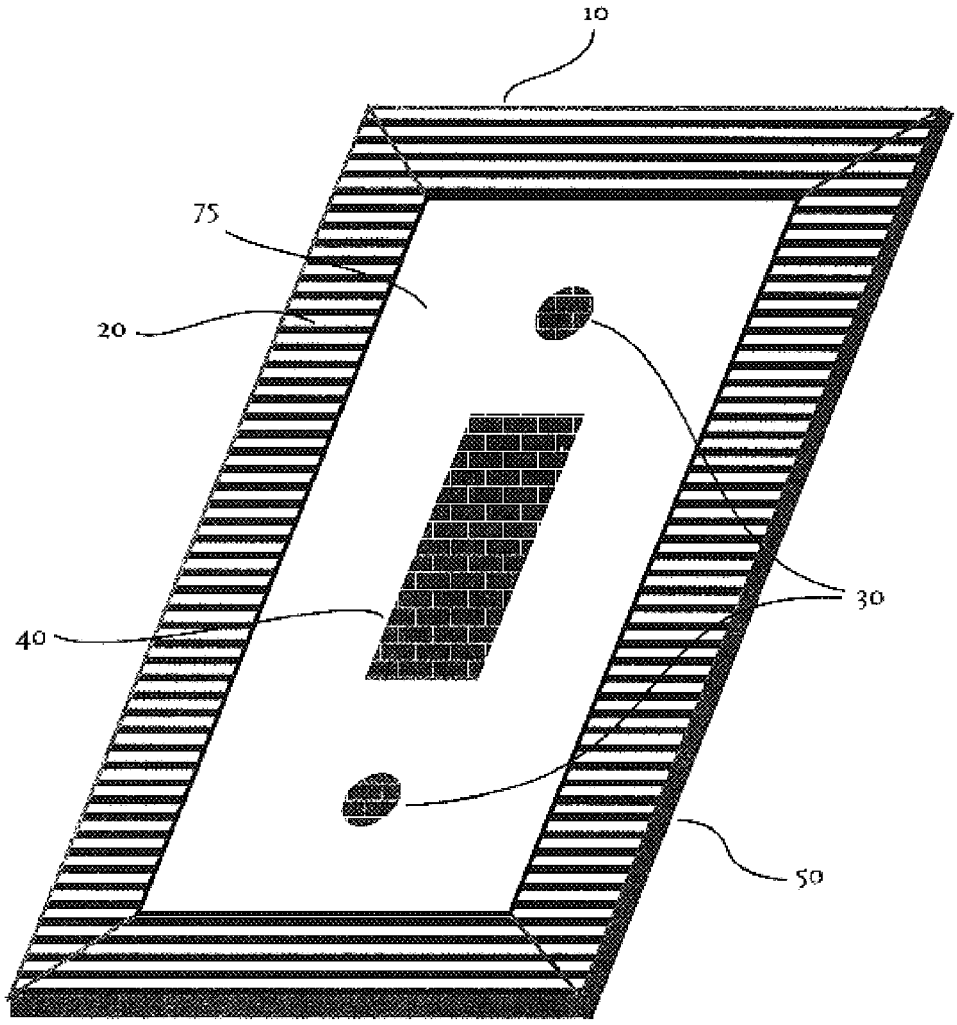

Referring now to the drawings, several preferred embodiments of the invention will be described.

FIG. 1 depicts a front view of a wallplate 10 for a switch. The outer surface 75 of the wallplate is shown, depicting the contact electrode 20, set at the periphery of the wallplate, spatially separated from the switch aperture 40 and mounting screw holes 30. The electrode may be set at any convenient area on the wallplate, or protrude from the wallplate and be supported therefrom. The contact electrode 20 is constructed to be easily accessible when the wallplate is mounted to an electrical fixture. Preferably, the wallplate 10 is formed of an electrically insulating material, and a contact electrode 20 is deposited on the wallplate, for example by a metalization process. Alternatively, the electrode may be formed by fitting a metal cover over the wallplate or by printing or otherwise depositing a conductive or resistive material onto the wallplate. IN yet another embodiment, the contact electrode is constructed to at least partially surround the wallplate and be supported by it. While the preferred embodiment calls for conductive contact electrode 20, it may be composed of a resistive material as well, as long as the resistance path is not so altered as to block efficient charge dissipation to ground. A resistive electrode may form a portion of the resistor 15 in the discharge circuit or replace the resistor altogether. If desired, the electrode 20 may be formed or printed in an aesthetic pattern to increase the device aesthetic appeal. Preferably if such a pattern is used, most of the pattern elements should be electrically connected to each other, so as to avoid 'dead zones' which do not offer a discharge path to ground.

As described, in the preferred embodiment, the electrode is located, substantially as shown in FIG. 1, on the outer periphery of the outer surface 75, or in close proximity thereto. If the wallplate supports external components that introduce low resistive path to ground, such as grounded metallic mounting screws, consideration should be given to distance the contact electrode from such components to reduce the risk of arcing between the grounded component and the electrode 20. In certain embodiments of the invention, the electrode may be deposited on the periphery as shown, and a pattern (not shown) of resistive material deposited on the outer surface 75 to form a resistive path to such grounded component. The preferred embodiments call for the discharge circuit components to be printed on, or otherwise mounted on the inner surface of the wallplate. The contact electrode 20 may be deposited anywhere on or near the outer surface or edge of the wallplate, and does not have to cover the all the periphery. Using non-conductive mounting methods such as plastic fasteners to mount the wallplate 10, allows all the area of the outer surface 75 to become a contact electrode if desired. In such an embodiment, the wallplate as a whole may be made of conductive material, and the electrostatic discharge circuit components are insulated from the plate by any convenient manner.

Figure 2:
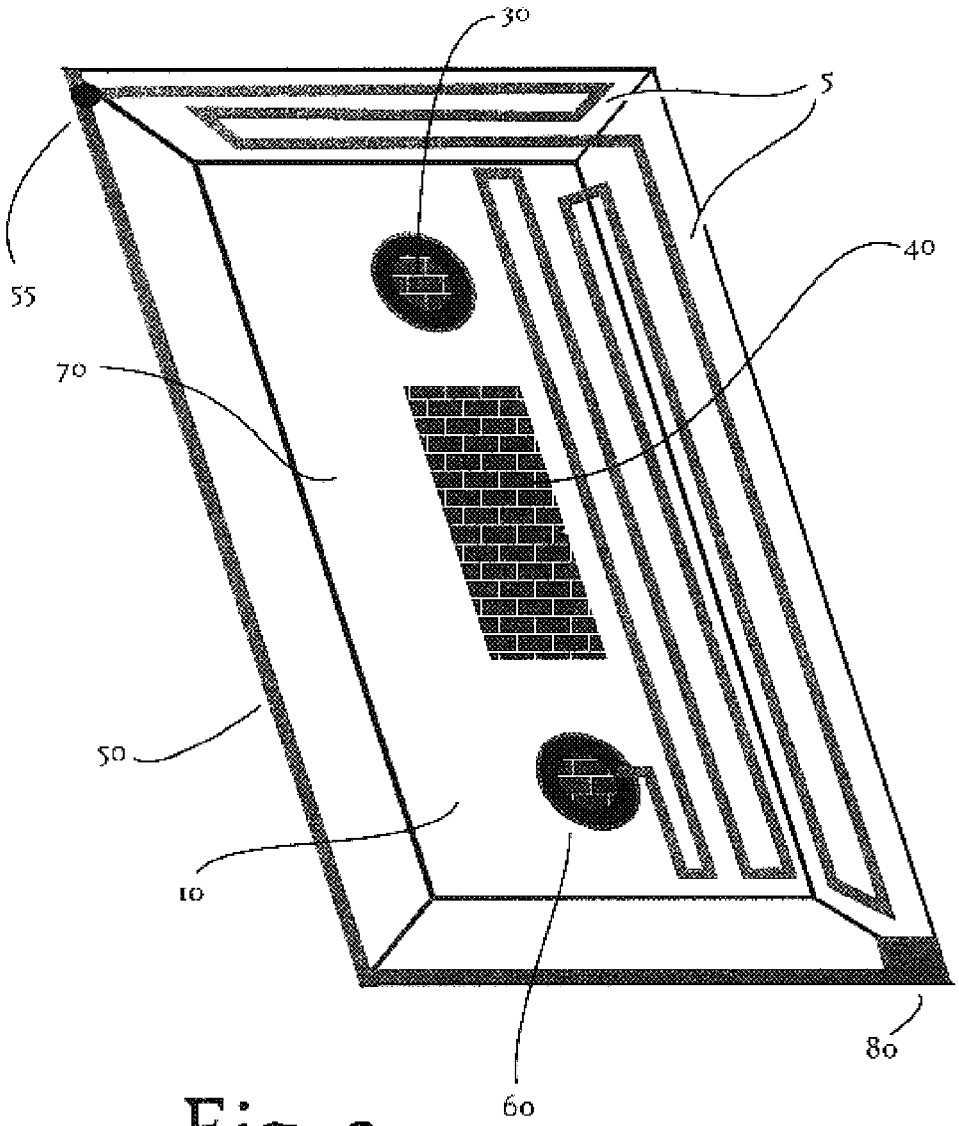

FIG. 2 depicts a rear view of a wallplate. This inner surface 70 of the wallplate lies within the gem box when the wallplate is mounted. In the preferred embodiment, a grounding point 60 is formed proximal to mounting screw hole 30. A pattern 5 of resistive material such as resistive carbon ink is laid to form the resistor 15, on the back, or inner surface 70 of wallplate 10. The pattern is formed with two terminal points, one in electrical communication with grounding point 60, and the second in electrical communication with contact electrode 20. The pattern thus acts as a resistor 15 and provides high impedance path for the electrical charge to flow from contact electrode 20 to grounding point 60. While in the preferred embodiment, the resistor and other discharge components are attached to the inner surface 70 of wallplate 10, in another embodiment (not shown), the resistive pattern is laid on the outer surface 75, connecting contact electrode 20 and grounding point 60. Thus the resistor may be deposited on either surface of the wallplate, or may be divided between the outer and inner surfaces.

Figure 6:
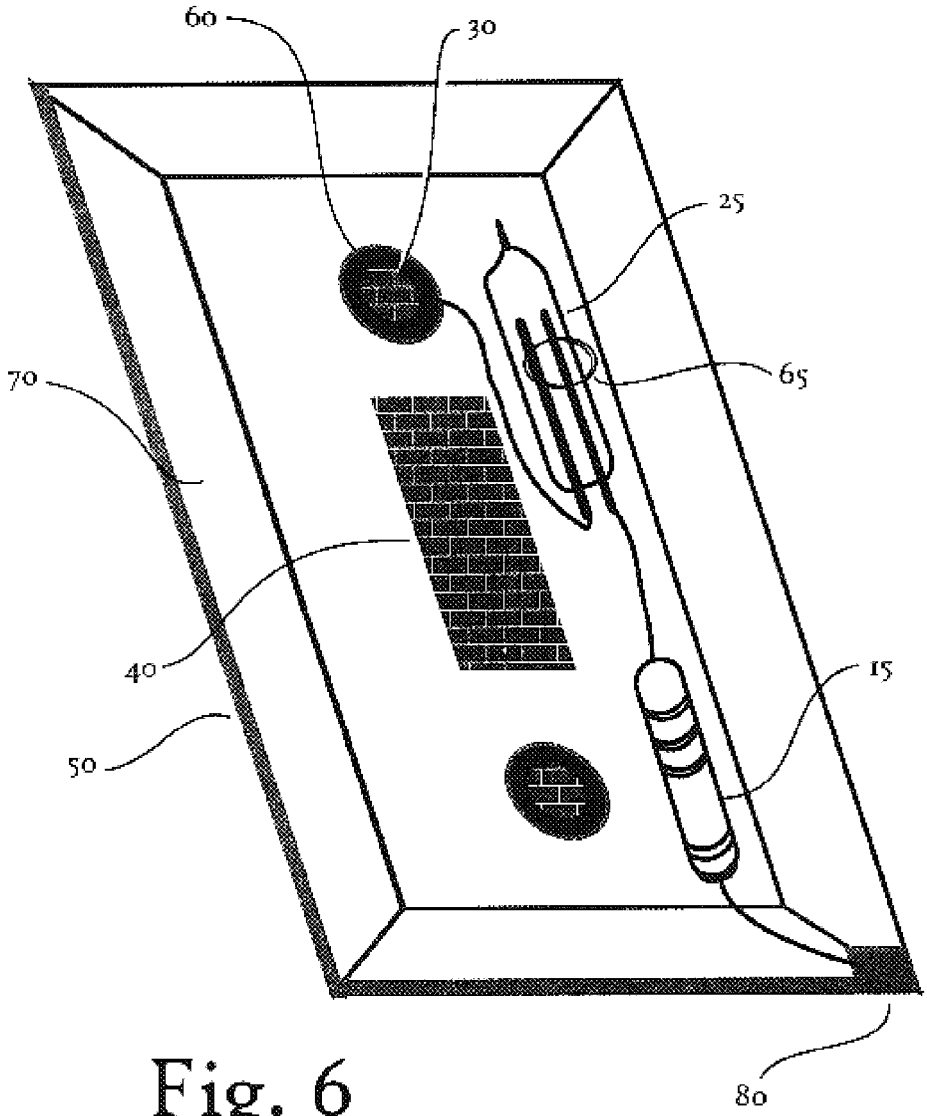
FIG. 6 depicts another rear view of an embodiment of the invention employing a neon bulb as a non-linear discharge component.

If desired, a common prepackaged resistor similar to those used as a component in electronic apparatuses, may be used instead of the pattern 5, to form the resistive portion of the discharge circuit, as shown in FIG. 6. If such a resistor is selected, it should preferably be of a type capable of withstanding the high voltages involved. Consideration should also be given to avoid arcing between the resistor terminals. As will be apparent to a person skilled in the art, several ways of providing an electrical path having high resistivity or high impedance path between those the two terminal points, such as placing coils, capacitors, and similar components. However these embodiments, while contemplated, are considered less desirable. Tests showed that a total resistance of fifteen to twenty megaohms is sufficient to minimize the effect of electrostatic charge dissipation, while providing fast and efficient discharge. Lower resistance values may as well be appropriate and could provide sufficient slowdown of the discharge as to affect the object of this invention, but are less desirable. Conversely, a very high resistance may be used, as long as an acceptable rate of charge dissipation is provided via the discharge circuit. Tests have shown that a resistor of 100 megaohm preformed well, without requiring a non-linear discharge component.

The contact electrode 20 and the resistor may be connected by any convenient method such as depositing conductive or resistive material on the wallplate edge 50, and connecting the resistor to this conductive or resistive edge as shown in 55 by way of example. Other methods for connecting the inner surface 70 circuitry with the outer surface 75 circuitry such as holes formed in the wallplate and filled with conductive or resistive material, plated through hole as is commonly done in the production of printed circuits, or a fastener attached to electrical components of the inner and outer surfaces of the wallplate 10, are just a few of the well known manners to provide an electrical path between the circuit components. Selection of the desired method is a matter of technical choice.

In the preferred embodiment, a neon bulb 25 is connected in series with resistor 15, to act as a non-linear discharge component. As was described before, several types of non-linear discharge components may be used to further reduce the unpleasant effects of electrostatic discharge. A neon bulb provides a good choice due to its low cost, good short-term power dissipation capacity, relative insensitivity to high voltages, and the added advantage of providing a visual indication of discharge in the form of glowing light. FIG. 6 depicts such an embodiment where the neon bulb 25 is connected in series with the resistor 15. A viewing aperture 65 is optionally provided, through which at least a portion of neon bulb 25 is visible, to allow visual indication of charge flow. Alternatively, the wallplate may be formed of transparent or semi-transparent material. FIG. 6 also shows an alternative method of connection between the components mounted on the outer surface 75 and the inner surface 70, by providing a tab or a pad 80, onto which the resistor lid may be soldered, or otherwise attached.

Another embodiment may achieve an effect similar to that of the neon bulb by providing a gap 17 in the resistive pattern 15 to act as a spark gap. Due to the high potential of electrostatic charge, an arc or a corona discharge will bridge the gap, affecting the discharge. The gap width will determine the minimum charge to begin an electrostatic discharge, as the charge level will have to be sufficient to begin the arc. A spark gap based implementation may provide a significant manufacturing cost savings, while retaining many of the advantages of a circuit comprising a neon bulb. The pattern 5 may be printed with a gap on the inner surface 70, or the gap may be created on the edge of the wallplate, or at the grounding point. With a spark gap implementation, depositing of the contact electrode 20, the circuit comprising the resistor 15, the non linear component 17, and the grounding point 60, may be achieved in a single manufacturing step.

Most wall plates have one or more apertures, or holes, to receive securing fasteners such as screws. In one preferred embodiment, grounding point 60 is primarily a contact area constructed to contact, i.e. electrically engage a conductive mounting screw or fastener, disposed in mounting screw hole 30. Plating the inner surface of the mounting screw hole, or the wallplate surface which the screw contacts with conductive or resistive material, will achieve sufficient grounding. A metallic screw or other fastener would provide a low impedance path between the grounding point and the electrical ground, since in most installations the switch is constructed to ground the screw or fastener. While a good connection between the screw and the grounding point 60 is desired, it is not necessary since a resistive connection is likely to offer a grounding path due to the high voltages involved. Even a small gap will likely suffice since the high voltage charge will arc across it.

Other methods of grounding are envisioned as well. By way of non-limiting example, a grounding electrode 140 adapted to flexibly engage with an electrical ground contact point in the electrical fixture may be provided. Such grounding electrode is preferably formed by a spring electrically connected to the discharge circuit and may be mounted coaxially to the fastener, where the spring contacts the switch or electrical fixtures and provides a grounding path. Clearly, the spring or other contact may be constructed in any convenient location to touch a grounding point in the electrical fixture or the gem box, and provide a grounding path. Alternatively, the contact may comprise a prong adapted to mate with a grounding point on the fixture or a grounded gem box. Generally, any grounding point that comprises a rearwardly extending contact, constructed to produce electrical contact with an electrical ground circuit when the wallplate is mounted to an electrical fixture, will produce the desired result. Grounding may also be achieved by a wire connected to ground and to the wallplate grounding point, but this approach is less desirable.

Figure 3:
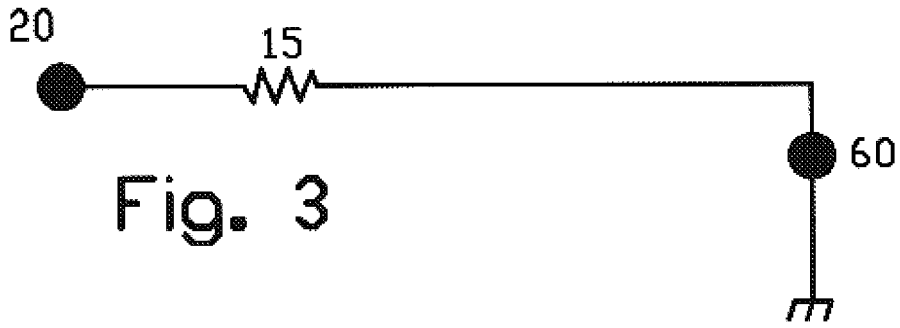
Figure 4:
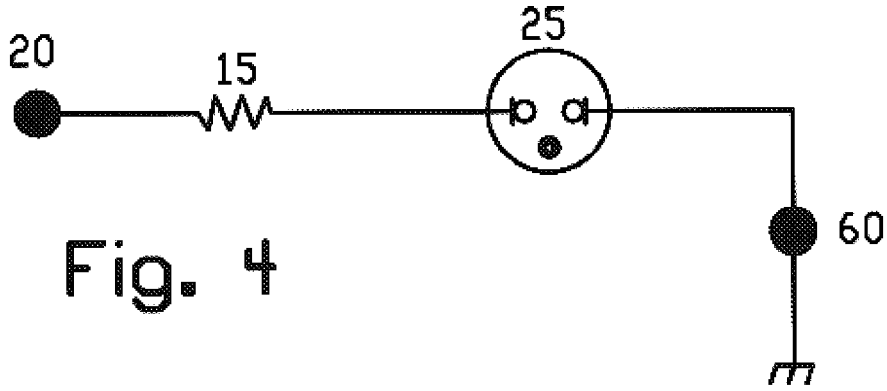
Figure 5:
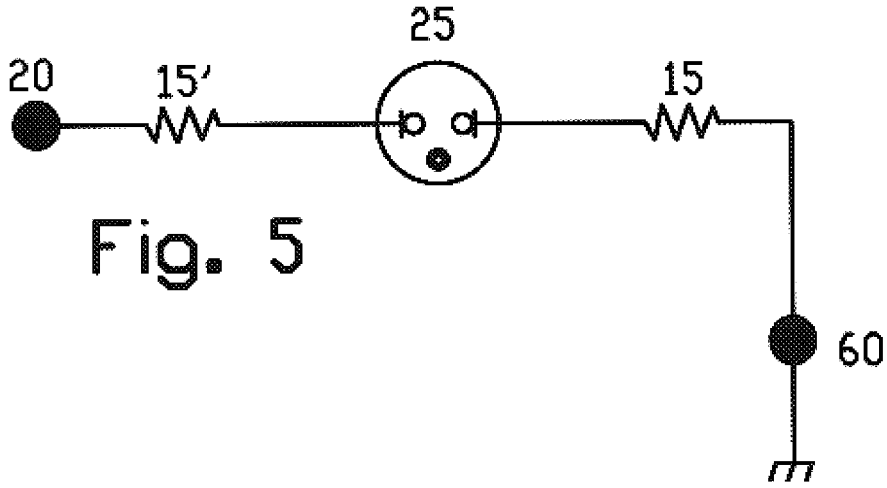

As will be appreciated by persons skilled in the art, the resistor 15 may be created from a plurality of resistors and the non-linear discharge component 25 may be connected on each side of the resistor or between several resistors, as long as a primarily series circuit having high resistance value is maintained between the contact electrode and the grounding point. FIGS. 3, 4, and 5 depict some examples of the circuit, where FIG. 3 shows the most basic circuit, which includes only resistor 15 electrically placed between electrode 20 and grounding point 60. FIG. 4 shows a schematic in which a neon bulb 25 is connected in series with resistor 15, to form the circuit between the electrode 20 and grounding point 60. FIG. 5 is yet another connection method where the circuit resistance is split between resistor 15 and resistor 15'. The main requirement of the discharge circuit is to present a high electrical impedance circuit between two terminal points, one point electrically coupled directly or indirectly to the contact electrode and the second terminal point electrically coupled, directly or indirectly, to the grounding point. Other requirements of the circuit are clearly the ability to withstand the energy and voltage levels involved with such discharge, and slowing the discharge rate to a comfortable level. Numerous such circuit configurations are apparent and are equivalent to the circuit described herein for the scope of the present invention.

Tests showed an advantage to using a round of flat contact electrode over a pointed electrode. In tests, a pointed electrode increased the risk of arcing between a human finger and the electrode. It is surmised that this fact is due to better distribution of the electrostatic charge when a flat or rounded shape electrode is used, as opposed to a pointed electrode that will increase charge density near the electrode tip sufficiently to cause an insulation breakdown resulting in a spark.

Figure 7:
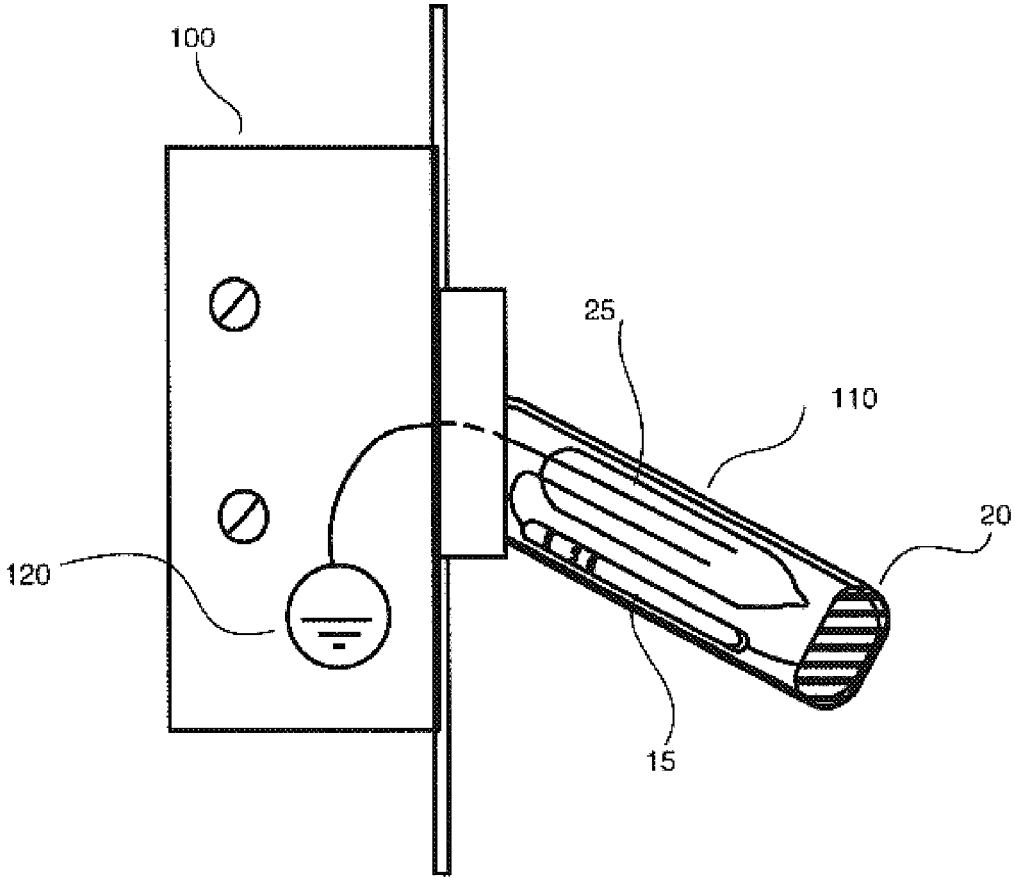
FIG. 7 is a side view of another embodiment of the invention, wherein the discharge circuit lies inside a switch, and the contact electrode is formed on the switch handle.
Figure 8:
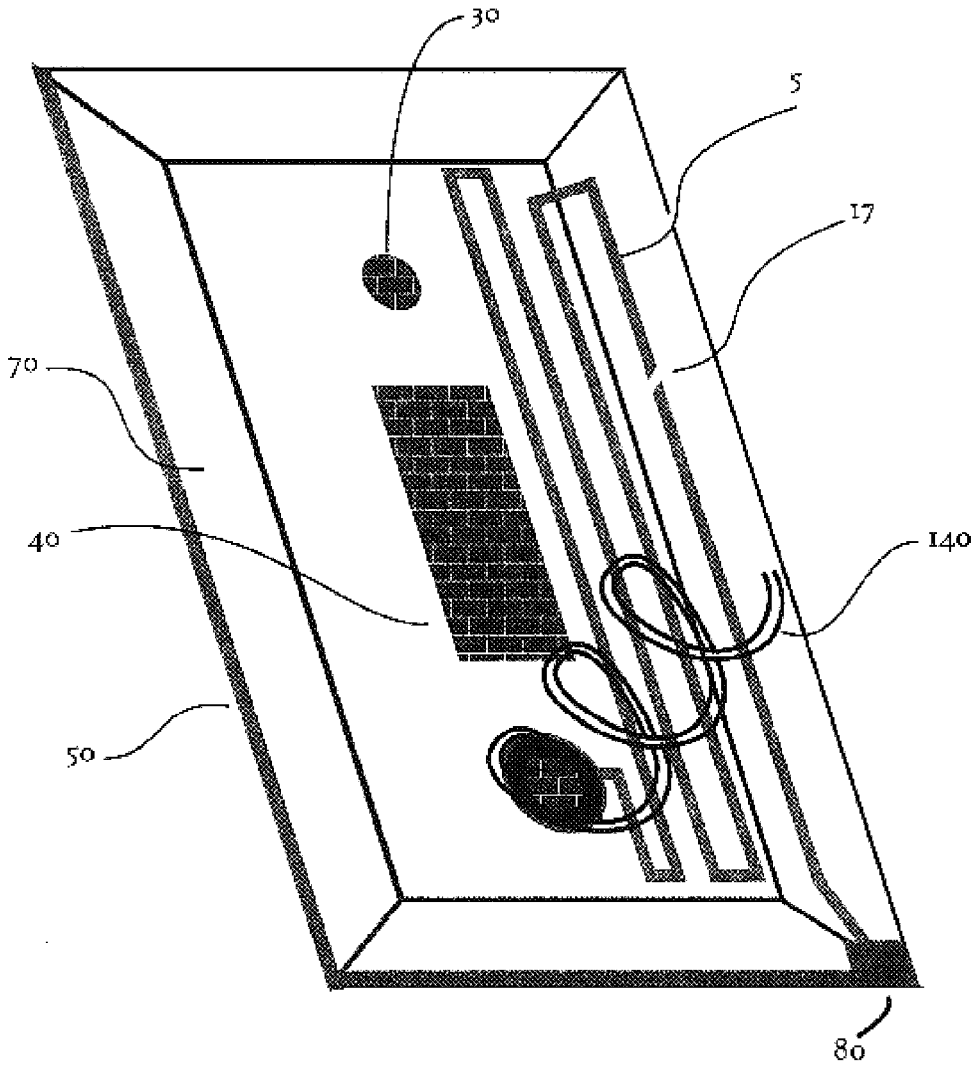
FIG. 8 is another rear view of a wallplate in accordance with the present invention showing a spark gap employed as a non-linear discharge component.

The switch handle itself, or a portion of it, may form the contact electrode 20. Switches exist with a neon bulb embedded in switch body, often in the handle. Metalization of a portion of the switch handle, would form a contact electrode 20, which may then be electrically connected to resistor 15 which is in turn connected in series with the neon bulb that acts as non-linear discharge component 25, as shown in FIG. 7. At present, such device may not be compatible with certain electrical codes, but when made with proper care to safety may make an excellent and effective electrostatic discharge device in accordance with the present invention. Alternatively, the electrostatic discharge circuit may be divided where a portion of the circuit, the resistor for example, is deposited on the wallplate 10, and another portion is built in the fixture, such as the non-linear discharge component 25. When the switch handle being metalized or otherwise utilized as the contact electrode, one end of the resistive pattern 5 may be routed proximal to the switch handle aperture. Thus a contact may be established between the electrode and the pattern, or the pattern may end in proximity to the handle and a spark gap formed between the electrode and the resistive pattern.

In other embodiments, the wallplate may be formed partially or wholly of material having a high specific resistivity. In such embodiment the resistor 15 is formed of the wallplate body itself. Grounding may be performed by any convenient means, and designating a certain area having sufficient resistance between it and the grounding point provides a contact electrode.

If required, an insulating layer may be provided to partially or wholly encapsulate any component of the discharge circuit mounted to the inner surface 70 of the wallplate. Such encapsulation may be affected by any convenient manner, such as by a sheet of insulating material mounted behind the component to be protected, encapsulating the circuit or parts thereof in an insulating material such as plastic, depositing protective tubing or a conformal coating over portions of the circuit, and other method apparent to those skilled in the art.

Thus as described, the invention provides for an electrical fixture wallplate having an electrode means suspended therefrom, the electrode means being in electrical communication with an electrical ground, by electrostatic discharge circuit means.

Above have been described what are at present considered to be the preferred embodiments of this invention. It will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

What is claimed is:

1. An electrostatic discharge device comprising:

an electrical fixture wallplate having an outer surface and an inner surface, said wallplate having at least one grounding point;

a contact electrode comprising an electrically conductive or resistive pattern deposited substantially directly on the outer surface of said wallplate;

an electrostatic discharge circuit, comprising at least one resistor connected between a first and a second terminal points, and wherein the first terminal point is electrically coupled to said contact electrode, and the second terminal point is electrically coupled to said grounding point.

2. The electrostatic discharge device of claim 1 further comprising a non-linear discharge component connected in series with said resistor.

3. The electrostatic discharge device of claim 2 wherein said discharge component comprises a neon bulb.

4. The electrostatic discharge device of claim 3 wherein at least a portion of said neon bulb is visible.

5. The electrostatic discharge device of claim 1 wherein said electrical fixture wallplate comprises at least one aperture adapted to receive a securing screw, and wherein said grounding point comprises a contact area constructed to electrically engage a conductive screw inserted in said aperture.

6. The electrostatic discharge device of claim 1 wherein said electrode is supported from said wallplate.

7. The electrostatic discharge device of claim 1 wherein said grounding point comprises a rearwardly extending contact, constructed to produce electrical contact with an electrical ground circuit when said wallplate is mounted to an electrical fixture.

8. The electrostatic discharge device of claim 1 wherein said electrode is constructed to be accessible when said wallplate is mounted to an electrical fixture.

9. An electrostatic discharge device comprising:

an electrical fixture wallplate having an outer surface and an inner surface, said outer surface having at least one contact electrode deposited substantially directly thereupon;

an electrostatic discharge circuit attached to said wallplate, said circuit having a first and a second terminal points, said discharge circuit comprises at least one resistor; and wherein the first terminal point is electrically coupled to said contact electrode; and, a grounding point electrically coupled to said second terminal point.

10. The electrostatic discharge device of claim 9 wherein said electrode comprises an electrically conductive surface deposited on said outer surface.

11. The electrostatic discharge device of claim 10 wherein said electrode is deposited on or in proximity to the outer periphery of said outer surface.

12. The electrostatic discharge device of claim 9 wherein said electrical fixture wallplate comprises at least one aperture adapted to receive a securing screw, and wherein said grounding point comprises a contact area constructed to electrically engage a conductive screw inserted in said aperture.

13. The electrostatic discharge device of claim 9 wherein said resistor comprises a pattern made of resistive material deposited on said inner surface.

14. The electrostatic discharge device of claim 13 wherein said resistive pattern having a spark gap constructed therein.

15. The electrostatic discharge device of claim 9 wherein said resistor is deposited on at least one of said surfaces.

16. The electrostatic discharge device of claim 9 further comprising a non-linear discharge component, connected in series with said resistor.

17. The electrostatic discharge device of claim 16 wherein said non-linear discharge component is a neon bulb.

18. The electrostatic discharge device of claim 17 wherein said neon bulb is at least partially visible through said wallplate, or through an aperture therein.

19. The electrostatic discharge device of claim 9 wherein said wallplate is constructed to at least partially cover an electrical fixture, and wherein said grounding point comprises a grounding electrode adapted to engage with an electrical ground contact point in said electrical fixture.

20. The electrostatic discharge device of claim 9 wherein said wallplate is formed at least partially from a material having high specific resistivity, and wherein said resistor is formed integrally to said wallplate.

21. The electrostatic discharge device comprising:

an electrical switch having an operating handle;

a contact electrode deposited on said handle;

an electrical discharge circuit having at least two terminal points and comprising at least one resistor;

wherein said circuit having a first terminal point in electrical communication with said electrode and the other terminal point in electrical communication with an electrical grounding point.

22. The electrostatic discharge device of claim 21 wherein said circuit further comprises a non-linear discharge component connected in series with said resistor.

23. The electrostatic discharge device of claim 21 further comprising a wallplate having an inner surface, and wherein said electrode extends proximally to said inner surface; and, Wherein said resistor comprises a resistive pattern deposited on said inner surface, said pattern having at least one end thereof in proximity to or in contact with said electrode.

* * * * *